US006992630B2

(12) United States Patent
Parsche

(10) Patent No.: US 6,992,630 B2
(45) Date of Patent: Jan. 31, 2006

(54) ANNULAR RING ANTENNA

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 139 days.

(21) Appl. No.: 10/695,046

(22) Filed: Oct. 28, 2003

(65) Prior Publication Data

US 2005/0088342 A1 Apr. 28, 2005

(51) Int. Cl.
*H01Q 1/38* (2006.01)

(52) U.S. Cl. ..... 343/700 MS; 343/732; 343/867

(58) Field of Classification Search ..... 343/700 MS, 343/732, 830, 767, 866, 867
See application file for complete search history.

(56) References Cited

U.S. PATENT DOCUMENTS

| | | | | |
|---|---|---|---|---|
| 3,680,127 A | | 7/1972 | Richard | 343/708 |
| 5,764,196 A | * | 6/1998 | Fujimoto et al. | 343/867 |
| 5,767,813 A | | 6/1998 | Verma et al. | 343/744 |
| 5,864,323 A | | 1/1999 | Berthon | 343/788 |
| 5,905,467 A | | 5/1999 | Narayanaswamy et al. | 343/702 |
| 5,973,644 A | | 10/1999 | Haneishi et al. | 343/700 |
| 6,184,833 B1 | | 2/2001 | Tran | 343/700 |
| 6,300,914 B1 | | 10/2001 | Yang | 343/741 |
| 6,307,508 B1 | | 10/2001 | Nagasawa | 343/700 |
| 6,340,950 B1 | | 1/2002 | Smith | 343/700 |
| 6,593,886 B2 | * | 7/2003 | Schantz | 343/700 MS |

OTHER PUBLICATIONS

Kokotoff et al.; Royal Melbourne Institute of Technology, "Analysis and Design of Probe-fed Printed Annular Rings", Aug. 28, 2003; pp. 1-5.

Amari et al.; University of Victoria, Canada; "A Technique for Designing Ring and Rod Dielectric Resonators in Cutoff Waveguides", Microwave and Optical Technology Letters, vol. 23, No. 4, Nov. 20, 1999; pp. 203-205.

* cited by examiner

*Primary Examiner*—Shih-Chao Chen
(74) *Attorney, Agent, or Firm*—Allen, Dyer, Doppelt, Milbrath & Gilchrist, P.A.

(57) ABSTRACT

The antenna includes a substrate, such as a dielectric material, and an electrically conductive circular ring on the substrate and having an outer diameter and an inner diameter concentrically arranged. The outer diameter is less than 1/10 an operating wavelength, and preferably about 1/20$^{th}$, so that the antenna is electrically small relative to the wavelength. The inner diameter is in a range of $\pi/6$ to $\pi/2$ times the outer diameter, and preferably is $\pi/4$ times the outer diameter to enhance the gain relative to its area.

39 Claims, 2 Drawing Sheets

ANNULAR RING ANTENNA

FIELD OF THE INVENTION

The present invention relates to the field of antennas, and more particularly, this invention relates to a radiating planar or printed antenna that is configured to enhance the gain relative to its area.

BACKGROUND OF THE INVENTION

Newer designs and manufacturing techniques have driven electronic components to small dimensions and miniaturized many communication devices and systems. Unfortunately, antennas have not been reduced in size at a comparative level and often are one of the larger components used in a smaller communications device. In those communication applications at below 6 GHz frequencies, the antennas become increasingly larger. At very low frequencies, for example, used by submarines or other low frequency communication systems, the antennas become very large, which is unacceptable. It becomes increasingly important in these communication applications to reduce not only antenna size, but also to design and manufacture a reduced size antenna having the greatest gain for the smallest area.

In current, everyday communications devices, many different types of patch antennas, loaded whips, copper springs (coils and pancakes) and dipoles are used in a variety of different ways. These antennas, however, are sometimes large and impractical for a specific application.

Simple flat or patch antennas can be manufactured at low costs and have been developed as antennas for the mobile communication field. The flat antenna or thin antenna is configured, for example, by disposing a patch conductor cut to a predetermined size over a grounded conductive plate through a dielectric material. This structure allows an antenna with high sensitivity over several GHz RF waves to be fabricated in a relatively simple structure. Such an antenna can be easily mounted to appliances, such as a printed circuit board (PCB). However, none of these approaches focused on reducing the size antenna while providing the greatest gain for the smallest area.

SUMMARY OF THE INVENTION

In view of the foregoing background, it is therefore an object of the present invention to provide a radiating planar or printed antenna that is configured to enhance the gain relative to its area.

This and other objects, features, and advantages in accordance with the present invention are provided by an antenna including a substrate, such as a dielectric material, and an electrically conductive circular ring on the substrate and having an outer diameter and an inner diameter concentrically arranged. The outer diameter is less than 1/10 an operating wavelength, and preferably about $1/20^{th}$, so that the antenna is electrically small relative to the wavelength. The inner diameter is in a range of $\pi/6$ to $\pi/2$ times the outer diameter, and preferably is $\pi/4$ times the outer diameter.

The electrically conductive circular ring may have at least one gap therein, and may have first and second circumferentially spaced gaps therein. The first gap defines feed points for the antenna, and a tuning feature, such as a capacitive element, is associated with the second gap. The first and second gaps are preferably diametrically opposed. Alternatively, a magnetically coupled feed ring may be provided within the electrically conductive ring. The magnetically coupled feed ring has a gap therein, to define feed points therefor, and diametrically opposite a gap in the electrically conductive circular ring. Also, an outer shield ring may surrounding the electrically conductive ring and be spaced therefrom. The shield ring has a third gap therein. Furthermore, a feed structure, such as a printed feed line or coaxial feed line, is provided to feed the antenna.

A method aspect of the invention includes making an antenna by forming an electrically conductive circular ring on a substrate including forming an outer diameter of the electrically conductive circular ring to be less than 1/10 an operating wavelength so that the antenna is electrically small relative to the wavelength, and forming an inner diameter of the electrically conductive circular ring to be in a range of $\pi/6$ to $\pi/2$ times the outer diameter.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

The present invention is directed to a thin patch antenna that has the greatest possible gain for the smallest possible area, such as can be used as a wireless local area network (WLAN) antenna in a personal computer or personal digital assistant (PDA). The various embodiments of the antenna can also be used in security, tracking or identification tags, cell phones and any other device that requires a small printed antenna. The antenna is an inductor-type antenna and is planar or "2½ dimensional" as it has some minimal thickness. The antenna is annular or circular in geometry to obtain the maximum area for the minimum diameter while providing the optimal conductor surface.

Figure 1:
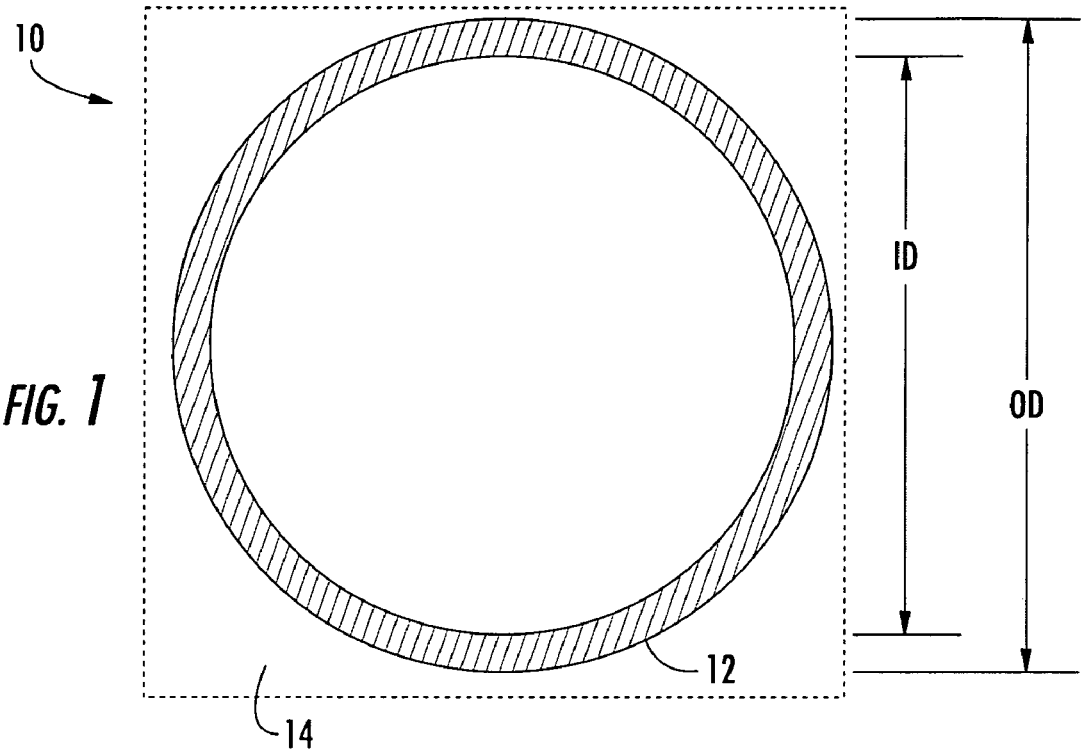
FIG. 1 is a schematic diagram of a loop antenna according to a first embodiment of the present invention.

Referring initially to FIG. 1, a first embodiment of an antenna 10 according to the present invention will be described. The antenna 10 includes an electrically conductive circular ring 12 on a substrate 14 and can be considered a loop antenna having about a one-half wavelength circumference in natural resonance. An inner diameter is in a range of $\pi/6$ to $\pi/2$ times the outer diameter, and preferably is $\pi/4$ times the outer diameter to enhance antenna gain relative to its area. The outer diameter is about $\lambda/2\pi$. Such an antenna 10 can be used as a radar reflector or proximity sensor, for example.

Figure 2:
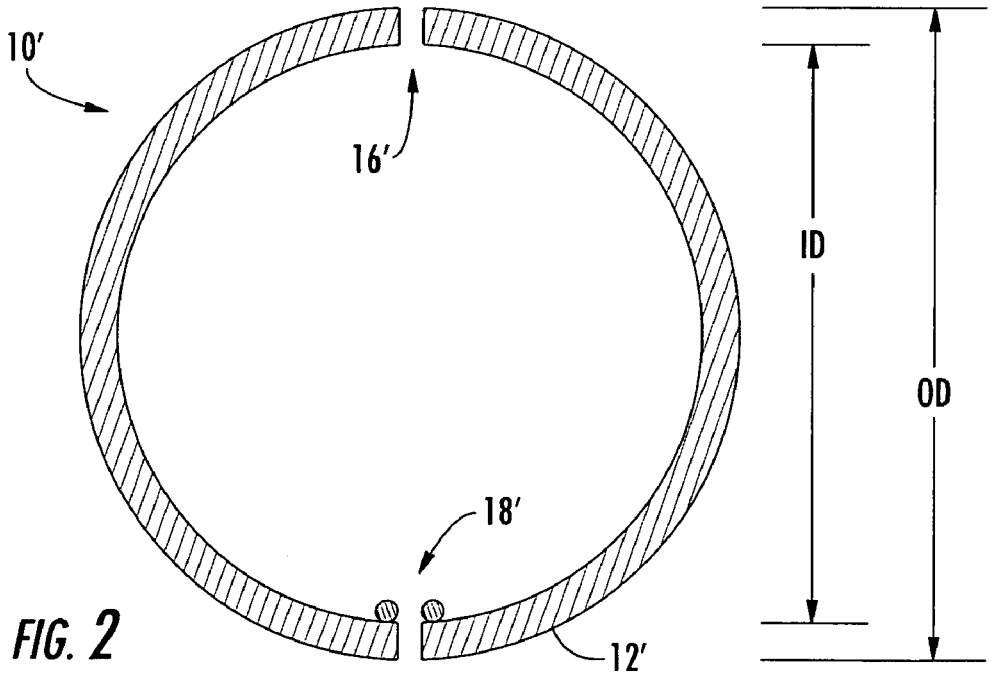
FIG. 2 is a schematic diagram of an annular antenna according to another embodiment of the present invention.

Referring now to FIG. 2, another embodiment of an antenna 10' according to the present invention will be described. The antenna 10' again includes an electrically conductive circular ring 12' on a substrate (not illustrated) and is an electrically small antenna that needs to be forced to resonance via a feed structure. In this embodiment, the outer diamter is is less than one-tenth (1/10) of the wavelength $\lambda$ and is preferably about one-twentieth (1/20) of the wavelength. Again, the inner diameter is in a range of $\pi/6$ to $\pi/2$ times the outer diameter, and preferably is $\pi/4$ times the outer diameter to enhance its gain relative to its area.

The electrically conductive circular ring 12' includes a capacitive element 16' or tuning feature as part of its ring structure and preferably located diametrically opposite to where the antenna is fed, for forcing/tuning the electrically conductive circular ring 12' to resonance. Such a capacitive element 16' may be a discrete device, such as a trimmer capacitor, or a gap, in the electrically conductive circular ring 12', with capacitive coupling. Such a gap would be small to impart the desired capacitance and establish the desired resonance. The electrically conductive circular ring 12' also includes a driving or feed point 18' which is also defined by a gap in the electrically conductive circular ring 12'. Furthermore, a feed structure, such as a printed feed line or coaxial feed line, for example a 50 ohm coaxial cable, is provided to feed the antenna, as would be appreciated by the skilled artisan.

Figure 3:
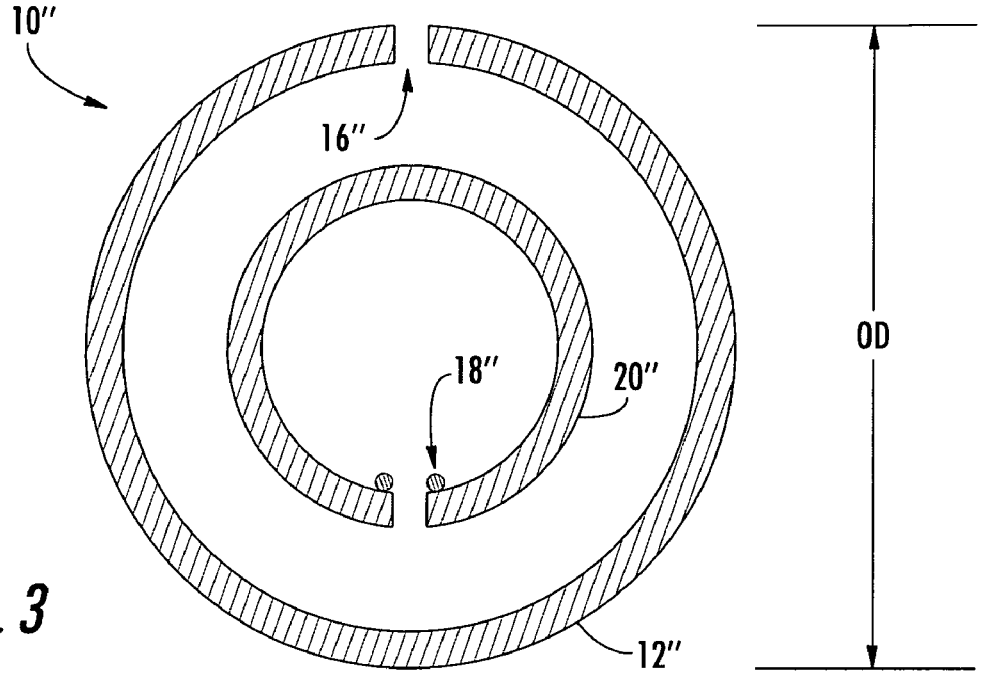
FIG. 3 is a schematic diagram of an annular antenna including a magnetic coupler according to another embodiment of the present invention.

Alternatively, in reference to FIG. 3, another embodiment of the antenna 10" will be described. Here, the antenna 10" includes a magnetically coupled feed ring 20" provided within the electrically conductive ring 12". The magnetically coupled feed ring 20" has a gap therein, to define feed points 18" therefor, and diametrically opposite the capacitive element 16" or gap in the electrically conductive circular ring 12". In this embodiment, the inner magnetically coupled feed ring 20" acts as a broadband coupler and is non-resonant. The outer electrically conductive ring 12" is resonant and radiates.

Figure 4:
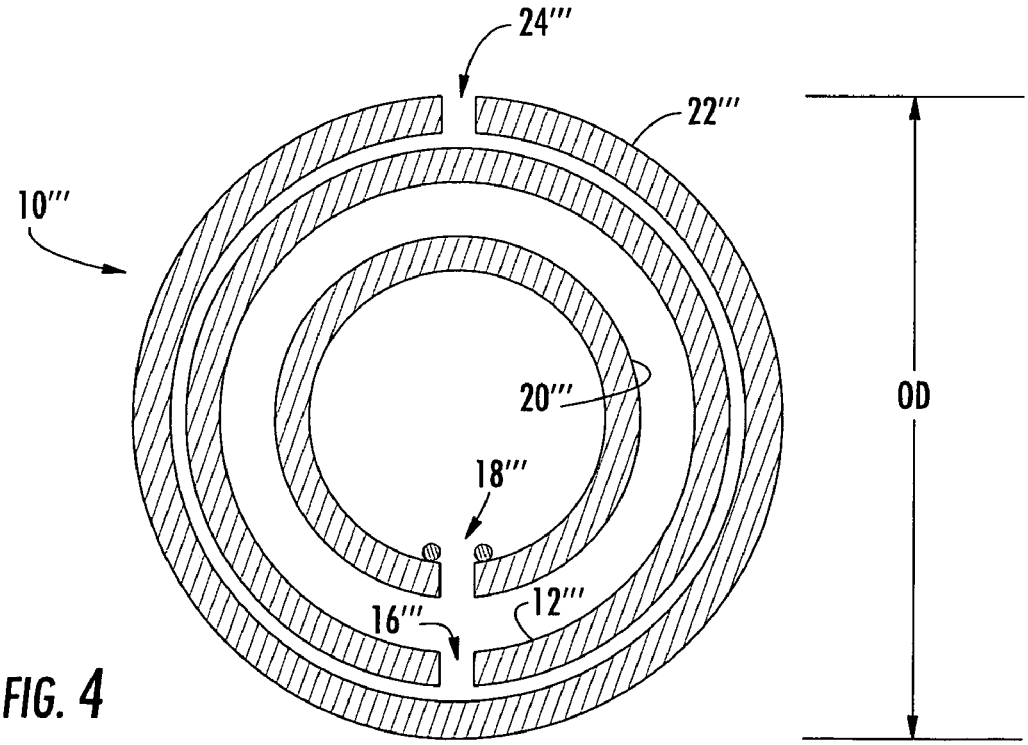
FIG. 4 is a schematic diagram of an annular antenna including a shield ring according to another embodiment of the present invention.

Also, with reference to the embodiment illustrated in FIG. 4, an outer shield ring 22''' may surround the electrically conductive ring 12''' and be spaced therefrom. The shield ring 22''' has a third gap 24''' therein. The outer shield ring 22''' and the electrically conductive ring 12''' both radiate and act as differential-type loading capacitors to each other. The distributed capacitance between the outer shield ring 22''' and the electrically conductive ring 12''' stabilizes tuning by shielding electromagnetic fields from adjacent dielectrics, people, structures, etc. Furthermore, additional shield rings 22''' could be added to increase the frequency bands and bandwidth.

A method aspect of the invention includes making an antenna 10', 10", 10''' by forming an electrically conductive circular ring 12', 12", 12''' on a substrate 14', 14", 14''' including forming an outer diameter of the electrically conductive circular ring to be less than 1/10 an operating wavelength so that the antenna is electrically small relative to the wavelength, and forming an inner diameter of the electrically conductive circular ring to be in a range of $\pi/6$ to $\pi/2$ times the outer diameter.

Again, the outer diameter is preferably about $1/20^{th}$ of lambda, and the inner diameter is preferably $\pi/4$ times the outer diameter. At least one gap 16' may be formed in the electrically conductive circular ring 12'. Also, first and second circumferentially spaced gaps 16', 18' may be formed in the electrically conductive circular ring 12', wherein the first gap 18' defines feed points for the antenna 10', and at least one tuning feature is associated with the second gap 16'. Here, the first and second gaps 16', 18' are diametrically opposed.

A magnetically coupled feed ring 20" may be formed within the electrically conductive ring 12". Here, the magnetically coupled feed ring 20" has the second gap 18" therein diametrically opposite the first gap 16" to define feed points therefor. Additonally, an outer shield ring 22''' may be formed to surround the electrically conductive ring 12''' and spaced therefrom. The shield ring 22''' has a third gap 24''' therein. In each of the embodiments, the substrate 14 preferably comprises a dielectric material, and a feed structure, such as a printed feed line or a coaxial feed line, would be provided to feed the antenna 10 as would be appreciated by the skilled artisan.

A non-limiting example of the annular antenna of the present invention is now described. A copper annualr ring antenna of less than 1/20 wavelengths in diameter can operate at a gain of 1 dBi, which is an efficiency of 85 percent. This antenna is implemented in copper at about 1000 MHz. This is the fundamental form of the antenna as a transducer of electromagnetic waves, in that a circle provides the greatest surface area for minimum diameter.

This very small and efficient annular antenna design of the present invention can be used in many different wireless products, including radio frequency communications and broadcasts including common consumer electronic applications, such as cell phones, pagers, wide local area network cards, GSM/land mobile communications, TV antennas, and high frequency radio systems. It can also be used in exotic applications, including VLF, GWEN, EMP weapons, ID tags, land mines and medical devices.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna comprising:

a substrate; and an electrically conductive circular ring on said substrate and having an outer diameter and an inner diameter concentrically arranged;

the outer diameter being less than 1/10 an operating wavelength so that the antenna is electrically small relative to the wavelength;

the inner diameter being in a range of $\pi/6$ to $\pi/2$ times the outer diameter.

2. The antenna according to claim 1 wherein the outer diameter is about $1/20^{th}$ of the wavelength.

3. The antenna according to claim 1 wherein the inner diameter is $\pi/4$ times the outer diameter.

4. The antenna according to claim 1 wherein said electrically conductive circular ring has at least one gap therein.

5. The antenna according to claim 1 wherein said electrically conductive circular ring has first and second circumferentially spaced gaps therein; wherein the first gap defines feed points for the antenna; and further comprising at least one tuning feature associated with the second gap.

6. The antenna according to claim 5 wherein the first and second gaps are diametrically opposed.

7. The antenna according to claim 1 further comprising a magnetically coupled feed ring within the electrically conductive ring.

8. The antenna according to claim 7 wherein the electrically conductive ring has a first gap therein; wherein the antenna further comprises at least one tuning feature associated with the first gap; and wherein said magnetically coupled feed ring has a second gap therein diametrically opposite the first gap to define feed points therefor.

9. The antenna according to claim 8 further comprising an outer shield ring surrounding said electrically conductive ring and spaced therefrom.

10. The antenna according to claim 9 wherein said shield ring has a third gap therein.

11. The antenna according to claim 1 wherein said substrate comprises a dielectric material.

12. The antenna according to claim 1 further comprising a feed structure to feed said electrically conductive circular ring.

13. The antenna according to claim 12 wherein said feed structure comprises a printed feed line.

14. The antenna according to claim 12 where said feed structure comprises a coaxial feed line.

15. An antenna comprising:

a substrate; and an electrically conductive circular ring on said substrate and having an outer diameter and an inner diameter concentrically arranged, said electrically conductive circular ring having at least one gap therein;

the outer diameter being less than 1/10 an operating wavelength so that the antenna is electrically small relative to the wavelength;

the inner diameter being $\pi/4$ times the outer diameter.

16. The antenna according to claim 15 wherein said electrically conductive circular ring has first and second circumferentially spaced gaps therein; wherein the first gap defines feed points for the antenna; and further comprising at least one tuning feature associated with the second gap.

17. The antenna according to claim 16 wherein the first and second gaps are diametrically opposed.

18. The antenna according to claim 15 further comprising a magnetically coupled feed ring within the electrically conductive circular ring.

19. The antenna according to claim 18 wherein the at least one gap comprises a first gap; said antenna further comprises at least one tuning feature associated with the first gap; and wherein said magnetically coupled feed ring has a second gap therein diametrically opposite the first gap to define feed points therefor.

20. The antenna according to claim 19 further comprising an outer shield ring surrounding said electrically conductive ring and spaced therefrom.

21. The antenna according to claim 20 wherein said shield ring has a third gap therein.

22. The antenna according to claim 15 wherein said substrate comprises a dielectric material.

23. The antenna according to claim 15 further comprising a feed structure to feed said electrically conductive circular ring.

24. The antenna according to claim 23 wherein said feed structure comprises a printed feed line.

25. The antenna according to claim 23 where said feed structure comprises a coaxial feed line.

26. A method of making an antenna comprising:

forming an electrically conductive circular ring on a substrate including forming an outer diameter of the electrically conductive circular ring to be less than 1/10 an operating wavelength so that the antenna is electrically small relative to the wavelength, and forming an inner diameter of the electrically conductive circular ring to be in a range of $\pi/6$ to $\pi/2$ times the outer diameter.

27. The method according to claim 26 wherein the outer diameter is about $1/20^{th}$ of lambda.

28. The method according to claim 26 wherein the inner diameter is $\pi/4$ times the outer diameter.

29. The method according to claim 26 further comprising forming at least one gap in the electrically conductive circular ring.

30. The method according to claim 26 further comprising forming first and second circumferentially spaced gaps in the electrically conductive circular ring; wherein the first gap defines feed points for the antenna; and further comprising forming at least one tuning feature associated with the second gap.

31. The method according to claim 30 wherein the first and second gaps are diametrically opposed.

32. The method according to claim 26 further comprising forming a magnetically coupled feed ring within the electrically conductive ring.

33. The method according to claim 32 wherein the electrically conductive ring has a first gap therein; wherein the antenna further comprises at least one tuning feature associated with the first gap; and wherein the magnetically coupled feed ring has a second gap therein diametrically opposite the first gap to define feed points therefor.

34. The method according to claim 33 further comprising an outer shield ring surrounding the electrically conductive ring and spaced therefrom.

35. The method according to claim 34 wherein the shield ring has a third gap therein.

36. The method according to claim 26 wherein the substrate comprises a dielectric material.

37. The method according to claim 26 further comprising providing a feed structure to feed the electrically conductive circular ring.

38. The method according to claim 37 wherein the feed structure comprises a printed feed line.

39. The method according to claim 37 wherein the feed structure comprises a coaxial feed line.

* * * * *